US009068413B2

(12) United States Patent
Doane

(10) Patent No.: US 9,068,413 B2
(45) **Date of Patent: *Jun. 30, 2015**

(54) MULTI-PISTON HYDROSTATIC SETTING TOOL WITH LOCKING FEATURE AND PRESSURE BALANCED PISTONS

(75) Inventor: James C. Doane, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 337 days.

This patent is subject to a terminal disclaimer.

(21) Appl. No.: 13/618,406

(22) Filed: Sep. 14, 2012

(65) Prior Publication Data

US 2014/0076535 A1 Mar. 20, 2014

(51) Int. Cl.

| | |
|---|---|
| ***E21B 23/04*** | (2006.01) |
| ***E21B 33/1295*** | (2006.01) |
| ***E21B 23/00*** | (2006.01) |
| ***E21B 41/00*** | (2006.01) |

(52) U.S. Cl.

CPC ..... *E21B 23/00* (2013.01); *E21B 33/1295* (2013.01); *E21B 23/04* (2013.01); *E21B 41/00* (2013.01)

(58) Field of Classification Search

CPC ..... E21B 23/04; E21B 33/1295

USPC ..... 166/386, 373, 212, 319, 317, 332.1, 166/381, 120

See application file for complete search history.

(56) References Cited

U.S. PATENT DOCUMENTS

| | | | | |
|---|---|---|---|---|
| 2,131,849 | A * | 10/1938 | Tolson | 175/45 |
| 4,658,902 | A * | 4/1987 | Wesson et al. | 166/317 |
| 5,447,202 | A * | 9/1995 | Littleford | 166/381 |
| 5,810,082 | A * | 9/1998 | Jordan, Jr. | 166/120 |
| 6,116,339 | A * | 9/2000 | Milne et al. | 166/125 |
| 6,186,227 | B1 * | 2/2001 | Vaynshteyn et al. | 166/120 |
| 8,132,619 | B2 * | 3/2012 | Smith et al. | 166/207 |
| 8,684,096 | B2 * | 4/2014 | Harris et al. | 166/382 |
| 2003/0019623 | A1 * | 1/2003 | King et al. | 166/120 |
| 2005/0006106 | A1 * | 1/2005 | Hirth et al. | 166/382 |
| 2008/0011471 | A1 * | 1/2008 | Hughes et al. | 166/120 |
| 2009/0200040 | A1 * | 8/2009 | Smith et al. | 166/380 |
| 2009/0229832 | A1 * | 9/2009 | King | 166/373 |
| 2009/0272544 | A1 * | 11/2009 | Giroux et al. | 166/382 |
| 2010/0252278 | A1 * | 10/2010 | Harris et al. | 166/382 |
| 2012/0230151 | A1 * | 9/2012 | Almaguer | 367/86 |
| 2013/0020092 | A1 * | 1/2013 | Ramon et al. | 166/381 |
| 2013/0037272 | A1 * | 2/2013 | Dale et al. | 166/363 |
| 2013/0092399 | A1 * | 4/2013 | Giroux et al. | 166/382 |
| 2013/0292137 | A1 * | 11/2013 | Lauderdale | 166/386 |
| 2013/0319693 | A1 * | 12/2013 | Sponchia et al. | 166/384 |
| 2013/0333873 | A1 * | 12/2013 | Giroux et al. | 166/66.6 |
| 2014/0076535 | A1 * | 3/2014 | Doane | 166/156 |

(Continued)

*Primary Examiner* — Jennifer H Gay

(74) *Attorney, Agent, or Firm* — Steve Rosenblatt

(57) ABSTRACT

A hydraulically actuated setting tool has a plurality of pistons that move in tandem when unlocked. The pistons are initially in pressure balance to take a load off a single locking mechanism that retains all the pistons. The pistons move due to admission of hydrostatic and/or applied pressure from the annulus on one side of each piston with an opposite side exposed to atmospheric pressure. The locking member is exposed to the annulus and is located away from any atmospheric chambers associated with the pistons. In this manner the components can be made thicker to resist burst and collapse pressure and the loads on the locking member reduced due to initial piston pressure balance configuration. Depths of greater than 8,000 meters can be used due to one or more of the described design features.

20 Claims, 5 Drawing Sheets

(56) References Cited

U.S. PATENT DOCUMENTS

2014/0076536 A1* 3/2014 Doane ..... 166/156
2014/0076537 A1* 3/2014 Doane ..... 166/156
2014/0216744 A1* 8/2014 Parlin ..... 166/285

* cited by examiner

MULTI-PISTON HYDROSTATIC SETTING TOOL WITH LOCKING FEATURE AND PRESSURE BALANCED PISTONS

FIELD OF THE INVENTION

The field of the invention is hydrostatically operated actuators for subterranean tools and more particularly in very deep applications where space is limited and high burst and collapse resistance is required for locking and actuation components.

BACKGROUND OF THE INVENTION

Technology has evolved to allow the drilling of wells to depths approaching 8,000 meters. At those depths the tools that are deployed have to resist rupture or collapse forces that are orders of magnitude higher than the original depths for which such tools were designed. At the same time space restrictions in such applications do not allow for simply scaling up the dimensions of all components to resist the heightened burst and collapse loads that could be encountered. The new conditions dictate a new approach to the tool to meet the often conflicting parameters of higher pressure differentials and limited space. Individual components that in old designs see increased differential pressure stresses now need to be rethought as to shape and placement in the tool to make the tool function reliably in a new high depth environment. While the ultimate mission of a tool may be unchanged, such as using hydrostatic pressure with the addition of pressure from the surface into an annulus to set a tool such as a packer, the configuration of the tool has to change to handle the new parameters that come into play from ultra-deep deployments of such tools.

The present invention is illustrated using an example of an existing tool discussed below and shown in FIG. 1 with a redesigned tool for deep applications shown in FIG. 2*a*-2*b*. While the context for the illustration of the inventive concept is hydrostatically operated tool actuators, the scope of the invention will be understood by those skilled in the art to be found in the appended claims.

FIG. 1 shows a model SB-3H Hydrostatic Setting Tool/Packer currently offered by Baker Hughes Incorporated of Houston, Tex. The packer has slips 3 that move out radially by riding up on cones 5, 16. In between the cones 5, 16 there is a seal assembly that is longitudinally compressed so that it extends radially in a well known manner. The seal assembly includes components 7 through 14 as illustrated in FIG. 1. A lock ring assembly 18, 19 holds the set position that is not shown. A stop ring 2 acts as a backup to the assembly of shifting pistons 23 and 39. When the pistons 23 and 39 are unlocked for movement toward the stop ring 2, the packer is set in the known manner.

In order to actuate, pressure in the annulus either rises to a predetermined value with depth or is raised to a predetermined value from the surface to break rupture disc 45. When that happens, the chamber between seals 33, 34 and 35 on one side and seals 30, 31 and 43 on the inside builds pressure on the piston 44 that initially traps the locking dog 41 to the mandrel 1. Dog 41 extends through a window in piston 39 and into an aligned groove in the mandrel 1 so as to keep piston 39 from moving until a recess on release piston 44 aligns with dog 41 to allow dog 41 to come out radially so that the piston 39 is no longer locked. The pressure that enters the chamber between seals 33, 34 and 35 on one side and seals 30, 31 and 43 on the inside then propels the piston 44 against the piston 39 for tandem movement as shear pin 40 breaks. Note that the driving force for piston 44 is the annulus pressure entering chamber 100, after the rupture disc 45 is broken, on one side and atmospheric pressure trapped in chamber 102 on the other side. Note also that the locking components for the piston 39 are in the atmospheric chamber 102. Chamber 104 is also initially at atmospheric pressure so as to put piston 39 initially in pressure balance to annulus pressure and to the opposed atmospheric chambers 102 and 104 acting in opposing direction.

Initially, piston 39 overlays dogs 38 to prevent movement of piston 23. Piston 23 is subjected to an unbalanced force with exposure to the annulus at its lower end near dogs 38 and exposure to atmospheric pressure from chamber 106 acting in opposition. Movement of piston 39 to liberate dogs 38 allows the unbalanced pressure on piston 23 to move uphole in tandem with piston 39 to set the packer in the manner described above.

While the above described design functioned well for moderate depth of about 5,000 meters the design incorporates features that at 8,000 meters or more would cause component failure making the device inoperable. One of the issues with the present design is the quantity of the net force that has to be retained by a lock assembly when any of the pistons is subjected to an unbalanced force before setting. The greater depths just magnify this force level causing the locking system to be more robust or to be subject to failure. However, the design also features not only a locking system for each piston but also location of at least a part of the locking system inside atmospheric chambers. At greater depths the differential pressures on atmospheric chambers are magnified forcing the components to be thicker walled structures to resist collapse or burst pressures. However, there is also the issue of lack of space in a borehole at depths of 8,000 meters and more that makes a locking system located in an atmospheric chamber problematic.

The present invention presents several unique and independent approaches to actuation tools triggered by hydrostatic or/and applied pressure in an annulus. One approach is to put multiple pistons in pressure balance to annulus pressure. Another is to move the locking mechanism from outside any atmospheric chamber. Yet another is to use a single locking mechanism for all the pistons and to reduce the loading on such a locking mechanism by using pressure balanced piston. The use of a single lock for all the pistons reduces component redundancy leaving space to make components thicker to handle the expected differential pressure loads at depths in excess of 8,000 meters. These and other features of the present invention will be more readily apparent from a review of the detailed description of the preferred embodiment and the associated drawings while recognizing that the full scope of the invention is to be found in the literal and equivalent scope of the appended claims.

SUMMARY OF THE INVENTION

A hydraulically actuated setting tool has a plurality of pistons that move in tandem when unlocked. The pistons are initially in pressure balance to take a load off a single locking mechanism that retains all the pistons. The pistons move due to admission of hydrostatic and/or applied pressure from the annulus on one side of each piston with an opposite side exposed to atmospheric pressure. The locking member is exposed to the annulus and is located away from any atmospheric chambers associated with the pistons. In this manner the components can be made thicker to resist burst and collapse pressure and the loads on the locking member reduced due to initial piston pressure balance configuration. Depths of greater than 8,000 meters can be used due to one or more of the described design features.

DETAILED DESCRIPTION OF THE PREFERRED EMBODIMENT

Figure 1:
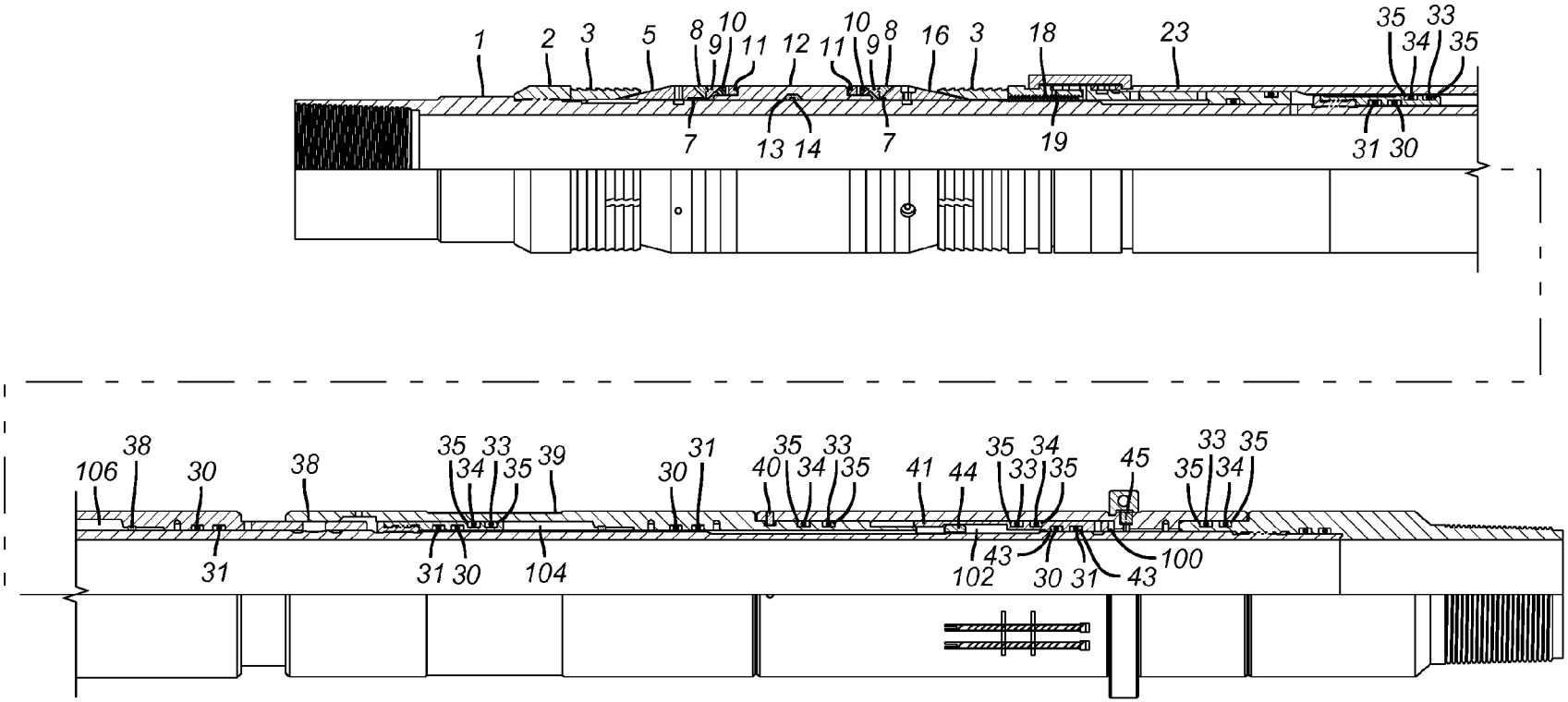
(PRIOR ART) FIG. 1
FIG. 1 is a section view of a known hydrostatic setting tool for a packer.
Figure 2A:
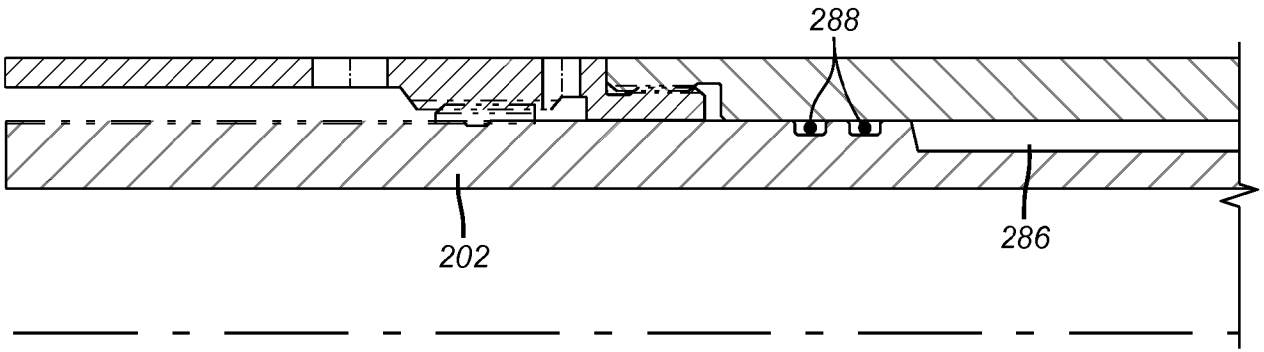
FIGS. 2*a*-2*d* are a section view of the tool of the present invention in the run in position.
Figure 4A:
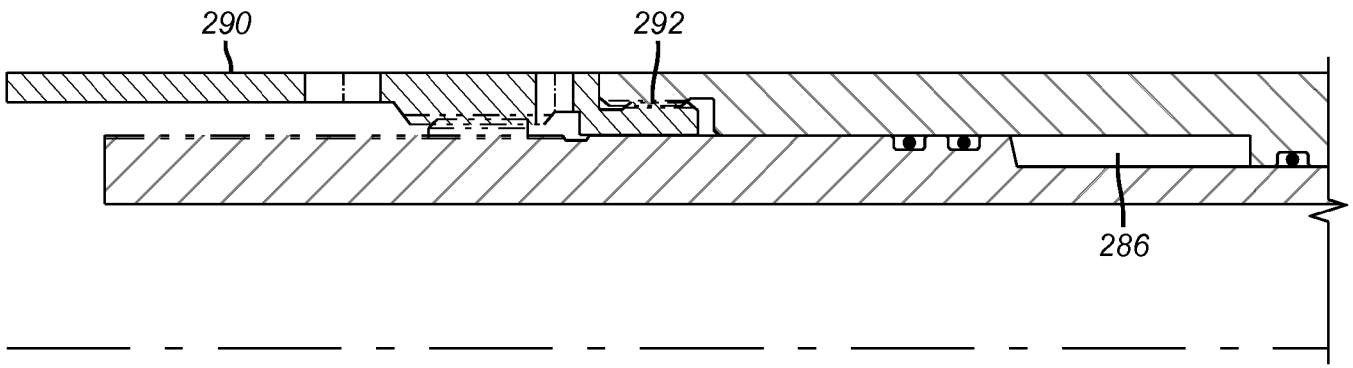
FIGS. 4*a*-4*d* are the tool of FIGS. 2*a*-2*d* in the fully released position.
Figure 2B:
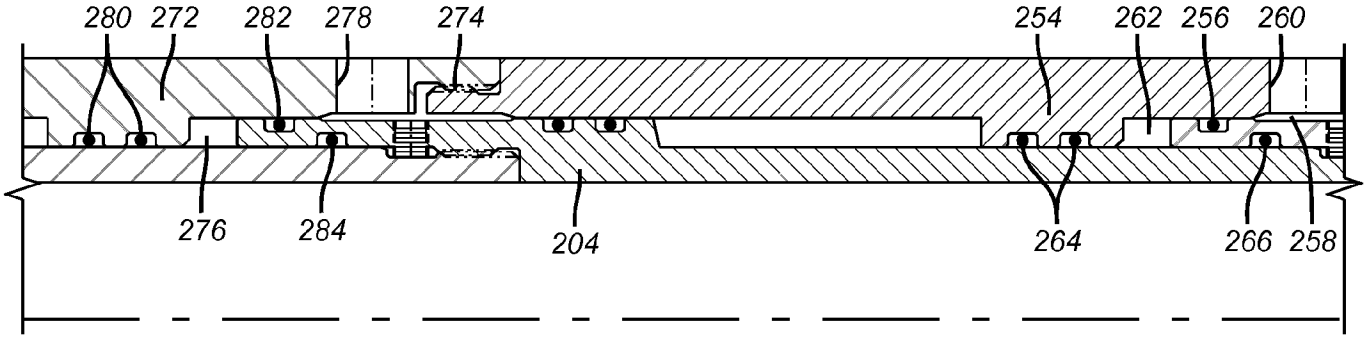

Referring to FIGS. 2*a*-2*d*, the tool 200 has a multi-component mandrel 202, 204 and 206 with mandrel 202 supported by a running string that also supports a tool to be set such as a packer. These uphole devices are omitted to focus the drawings on the tool 200, which is the focus of the present invention. A bottom sub 208 is connected to mandrel component 206 and can support other equipment or a tubular string which are also omitted. Collet housing 210 is secured at thread 212 to the bottom sub 208. Collet fingers 214 extend from lower end 216 at collet housing 210 and further features heads 218 with external thread pattern 220 to engage a mating thread pattern 222 on piston 224. Support piston 226 is initially fixed with one or more shear pins 228 for run in. Raised surface 230 initially supports the heads 218 so that the thread patterns 220 and 222 stay in engagement to prevent movement of piston 224. Rupture disc 232 initially covers passage 234 that leads to chamber 236 defined by seal pairs 238 and 240. When the rupture disc 232 is broken by hydrostatic pressure with or without added pressure from the surface, the raised pressure in chamber 236 pushes support piston 226 to the right so that thread patterns 220 and 222 can separate as the heads 218 become unsupported. Movement of support piston 226 to the right breaks the shear pin or pins 228 and displaces floating piston 242 toward shoulder 244 while reducing the volume of chamber 246 that is initially at atmospheric pressure for the purpose of creating a pressure differential against support piston 226 when the rupture disc 232 breaks as does the shear pin or pins 228.

Figure 3A:
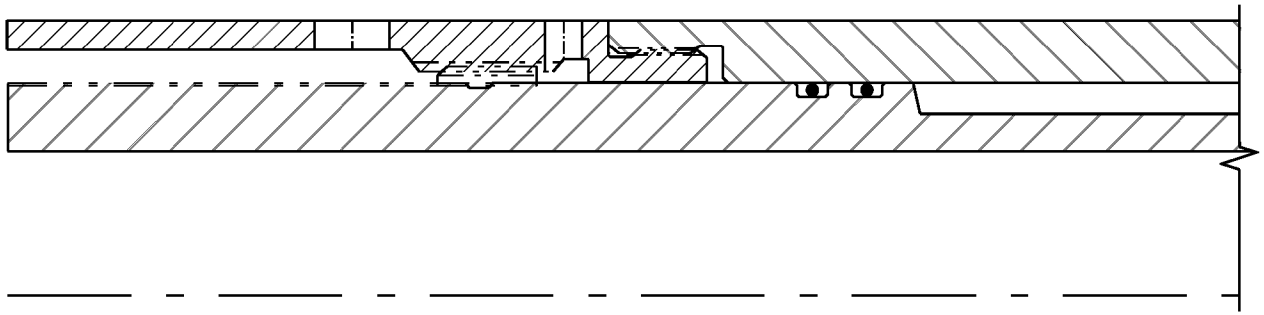
FIGS. 3*a*-3*d* are the tool of FIGS. 2*a*-2*d* shown in the lock about to release position.
Figure 3B:
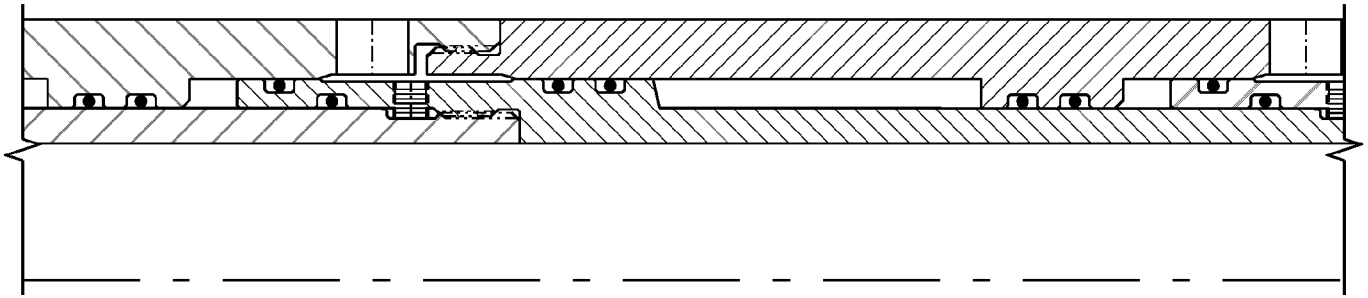
Figure 4B:
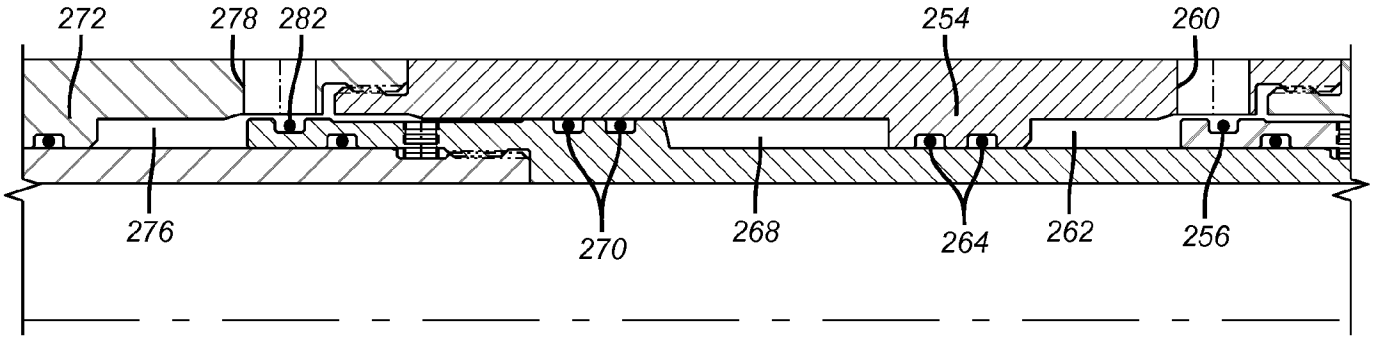
Figure 2C:
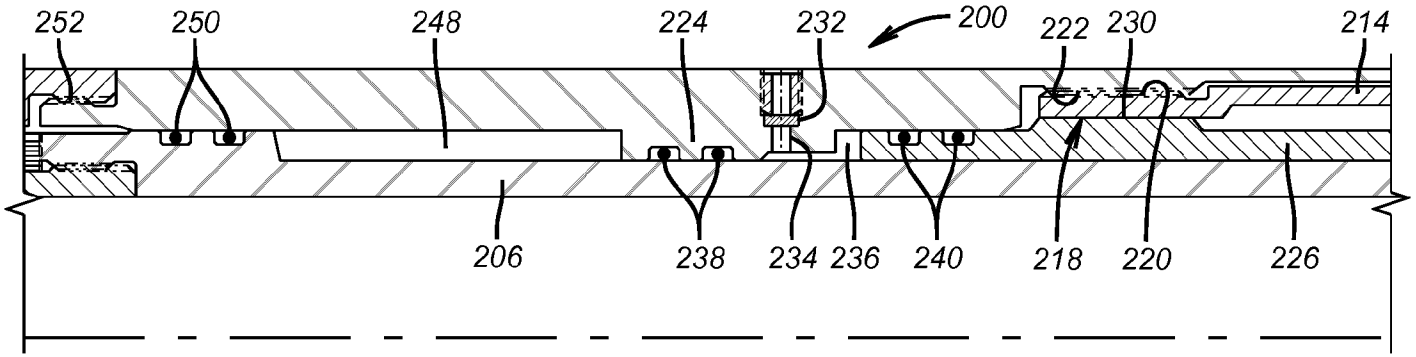
Figure 3C:
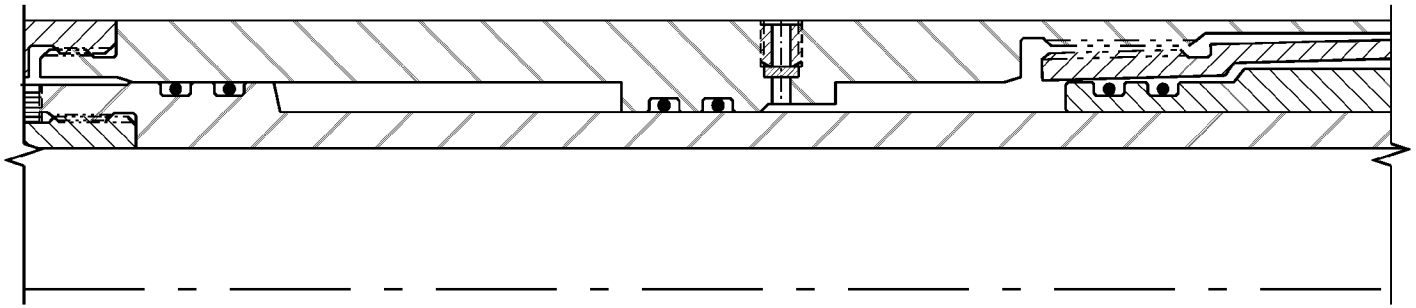
Figure 4C:
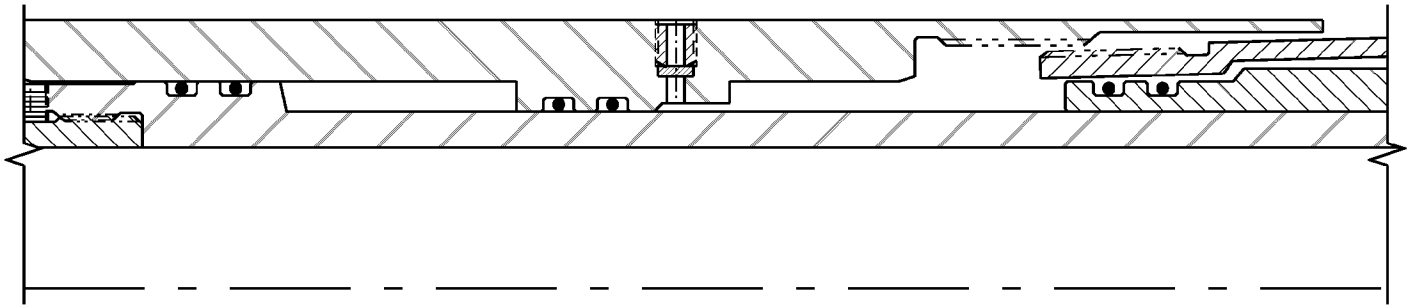
Figure 2D:
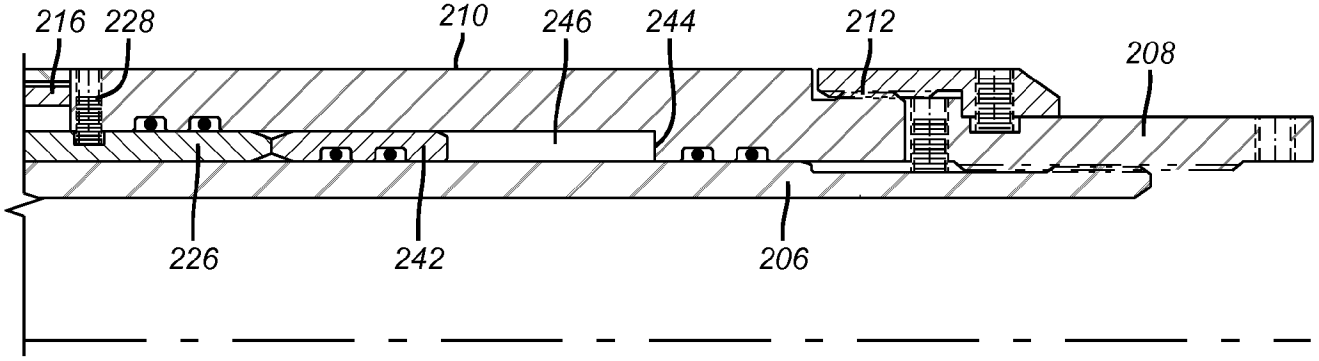
Figure 3D:
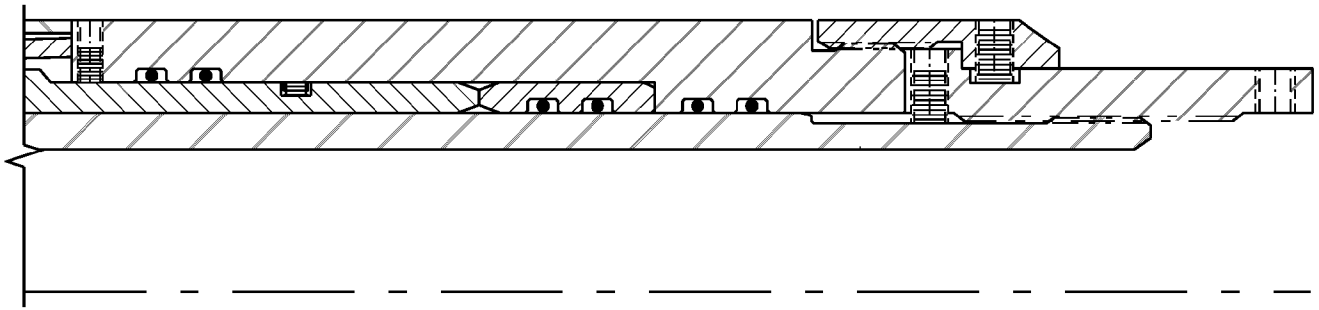
Figure 4D:
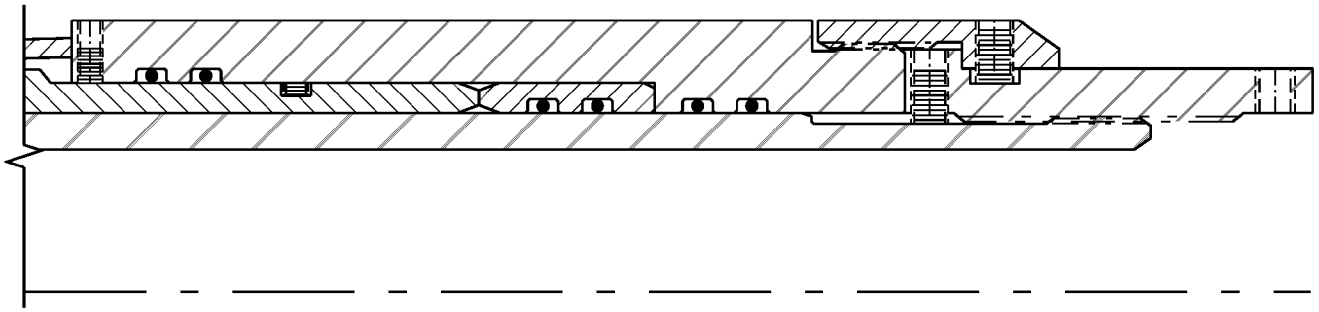

Chamber 248 is initially at the same pressure as chamber 236 to put the piston 224 in pressure balance from these opposed chambers. Seal pair 250 is the same size as seal pair 240 to make this pressure balance feature take effect. The piston 224 is threaded at 252 to piston 254. Seal 256 and seal pair 250 define a chamber 258 that is accessible to the annulus through open port 260. Chamber 262 is initially isolated from port 260 due to the run in position of seal pair 264 and seals 256 and 266. Comparing FIGS. 2*b* with FIGS. 3*b* and 4*b* it can be seen that movement of piston 254 exposes seal 256 to allow annulus pressure into chamber 262 so as to propel piston 254 against the resisting atmospheric pressure in chamber 268 defined between seal pairs 264 and 270. Piston 254 is initially in pressure balance from opposed chambers 262 and 268.

Piston 254 is attached to piston 272 at threads 274. Chamber 276 is initially isolated from open ports 278 by seal pairs 280 and seals 282 and 284. Chamber 276 is initially at the same pressure as chamber 286. Chamber 286 is defined by seal pairs 288 and 280. Chambers 276 and 286 maintain piston 272 in pressure balance until piston 272 moves to expose seal 282 which allows annulus pressure into chamber 276 from ports 278. As this movement happens the volume of chamber 286 is reduced and its internal pressure rises to some extent.

Actuating sleeve 290 is secured to piston 272 at thread 292. Movement of the sleeve 290 against a tool that is not shown in combination with mandrel 202 being held fixed such as with a running string also not shown is the relative movement that makes the unshown tool go to a set position.

The pistons 224, 254 and 272 are secured together for tandem movement. They are in pressure balance as an assembly to annulus pressure because seal pairs 240 and 288 are the same size to present equal and opposite piston areas on the joined pistons. Although three pistons are shown, other numbers of pistons can be used for greater or lesser actuating force as needed. Tying the pistons together allows the use of a singular lock such as the engaged threads 220 and 222 to retain all the pistons. The fact that the pistons are all in pressure balance also allows the use of a less beefy locking system. Locating the locking system in a place where there is exposure to the annulus pressure and outside the atmospheric or low pressure chambers such as 248 allows the ability to increase wall thicknesses of components that form such chambers such as the pistons or the underlying mandrel so that greater depths can be used for the setting tool 200 particularly when space restrictions present controlling design parameters.

While a locking mechanism of collet heads that become unsupported are illustrated in the preferred embodiment, other types of locking mechanisms are envisioned, such as dogs that are undermined or shear devices.

With the pistons in pressure balance during run in, the lock need only hold against contact friction of the pistons during run in because there is no net hydrostatic load during the trip to the desired location. The term "pressure balance" encompasses conditions of no net force in either direction up to and inclusive of a net force in one direction that is less than 5% of the force applied from either of the opposed chambers acting on a given piston. Thus the chamber pressures on opposed sides do not have to be the same. Alternatively, the pressures in the opposed chambers can be the same but the opposed piston areas can be different or both the chamber pressures and the piston areas can be different, all within the 5% either directional force from the opposed chambers.

The tool 200 can be a standalone setting tool or it can be integrated into the subterranean tool that it is setting and the term "setting tool" is intended to cover both configurations. Although the rupture disc 232 is shown oriented to the surrounding annulus it can alternatively be oriented to the passage within the mandrel 202, 204 and 206 or the bottom sub 208.

The above description is illustrative of the preferred embodiment and many modifications may be made by those skilled in the art without departing from the invention whose scope is to be determined from the literal and equivalent scope of the claims below:

I claim:

1. A hydrostatically actuated setting tool for a subterranean tool for operation at a subterranean location using hydrostatic pressure, comprising:

a mandrel;

a plurality of pistons disposed on said mandrel, said pistons formed to define a pair of opposed chambers adjacent each said piston that place each said piston initially in pressure balance when running in and before piston movement;

at least one lock assembly selectively operated with pressure at the subterranean location to selectively release said pistons to move, said pressure being at least in part hydrostatic pressure in the subterranean location adjacent said mandrel to actuate the subterranean tool.

2. The setting tool of claim 1, wherein:

said pistons are connected for tandem movement.

3. The setting tool of claim 2, wherein:

said pistons are in initial pressure balance from hydrostatic pressure in the annulus.

4. The setting tool of claim 3, wherein:

said at least one lock assembly comprises a single lock assembly located on said mandrel and outside said opposed chambers.

5. The setting tool of claim 4, wherein:

at least one of each pair of opposed chambers selectively opened to hydrostatic pressure.

6. The setting tool of claim 5, wherein:

an initial one of said pairs of opposed chambers is opened with hydrostatic pressure acting to open a port therein from the annulus.

7. The setting tool of claim 1, wherein:

said pistons are in initial pressure balance from hydrostatic pressure in an annulus about the setting tool.

8. The setting tool of claim 1, wherein:

said at least one lock assembly comprises a single lock assembly located on said mandrel and outside said opposed chambers.

9. The setting tool of claim 1, wherein:

at least one of each pair of opposed chambers selectively opened to hydrostatic pressure.

10. The setting tool of claim 9, wherein:

an initial one of said pairs of opposed chambers is opened with hydrostatic pressure acting to open a port therein from the annulus.

11. The setting tool of claim 10, wherein:

said port extends through one of said pistons.

12. The setting tool of claim 10, wherein:

said port is opened with breaking of a frangible member located in said port.

13. The setting tool of claim 10, wherein:

pressure in said opened port defeats said lock assembly.

14. The setting tool of claim 13, wherein:

pressure in said opened port shifts a support sleeve away from a collet to allow a first of said pistons, now subjected to an unbalanced force with one chamber exposed to hydrostatic pressure from said port and an opposed chamber of the pair of opposed chambers at a lower pressure, to move.

15. The setting tool of claim 14, wherein:

each said piston apart from said first piston has an associated port selectively opened to one of said pair of opposed chambers associated therewith;

all said associated ports being opened with initial movement of said first piston.

16. The setting tool of claim 14, wherein:

said lock assembly initially pinned against movement by at least one shear pin that is sheared with movement of said support sleeve.

17. The setting tool of claim 16, wherein:

said opposed chambers are configured to resist burst or collapse pressures with said mandrel disposed at depths greater than 8,000 meters.

18. The setting tool of claim 1, wherein:

movement of a first said piston unbalances the pressure on each of the remaining said pistons by opening one of said pair of opposed chambers associated with each said remaining pistons to pressure in the annulus.

19. The setting tool of claim 18, wherein:

said pistons are attached for tandem movement.

20. The setting tool of claim 1, wherein:

said opposed chambers are configured to resist burst or collapse pressures with said mandrel disposed at depths greater than 8,000 meters.

* * * * *